US006189625B1

(12) United States Patent
Hopkins

(10) Patent No.: US 6,189,625 B1
(45) Date of Patent: Feb. 20, 2001

(54) LIQUID MIST FIRE EXTINGUISHER

(76) Inventor: Gordon Duane Hopkins, 119 Clyde Avenue, Mount Pearl, NF A1N 4R9 (CA)

( * ) Notice: Under 35 U.S.C. 154(b), the term of this patent shall be extended for 0 days.

(21) Appl. No.: 09/306,017

(22) Filed: May 6, 1999

(51) Int. Cl.[7] ..... A62C 35/58

(52) U.S. Cl. ..... 169/88; 169/30; 169/74; 169/89; 239/372; 222/402.15

(58) Field of Search ..... 169/30, 74, 85, 169/88, 89; 239/302, 337, 369, 370, 371, 372, 375, 527, 414, 419, 433, 583, 353, 368; 222/402.1, 402.15, 545, 399; 137/597, 625.4, 625.48

(56) References Cited

U.S. PATENT DOCUMENTS

| | | | | |
|---|---|---|---|---|
| 689,107 | * | 12/1901 | Mitchell | 239/372 |
| 1,263,291 | * | 4/1918 | Schultz | 169/89 |
| 1,914,245 | | 6/1933 | Echola . | |
| 2,040,302 | * | 5/1936 | Fortier | 239/372 |
| 2,107,313 | | 2/1938 | Urquhart | 169/31 |
| 2,109,966 | * | 3/1938 | Breitmann | 169/89 |
| 2,755,865 | * | 7/1956 | Jacobs | 169/85 |
| 2,832,425 | | 4/1958 | Jacobs | 169/31 |
| 3,199,600 | | 8/1965 | Jacobs | 169/9 |
| 3,658,254 | * | 4/1972 | Lee | 239/372 X |
| 4,417,674 | | 11/1983 | Giuffredi | 222/402.18 |
| 4,505,336 | | 3/1985 | Thevis et al. | 169/85 |
| 4,815,541 | | 3/1989 | Arrington | 169/74 |
| 4,862,968 | | 9/1989 | Woodman . | |
| 5,676,210 | | 10/1997 | Sundholm | 169/9 |
| 5,799,735 | | 9/1998 | Sundholm | 169/9 |
| 5,845,716 | * | 12/1998 | Birk | 169/85 |

FOREIGN PATENT DOCUMENTS

| | | | |
|---|---|---|---|
| 2162235 | 6/1996 | (CA) | B05B/7/04 |
| 2235946 | 5/1997 | (CA) | B05B/7/08 |
| 2237014 | 5/1997 | (CA) | B05B/7/04 |
| 2225073 | 6/1998 | (CA) | B05B/7/20 |
| 27 47 588 | 5/1979 | (DE) . | |
| 197 24 339 A1 | 2/1998 | (DE) . | |
| 0 314 354 A1 | 10/1987 | (EP) . | |
| WO 97/02863 | 1/1997 | (WO) . | |

* cited by examiner

*Primary Examiner*—Patrick Brinson
*Assistant Examiner*—Steven J. Ganey
(74) *Attorney, Agent, or Firm*—McFadden, Fincham

(57) ABSTRACT

A liquid mist fire extinguisher, comprising a container for holding a gas and a liquid under pressure. The extinguisher has valve assembly at the upper end of the container, a valve for simultaneously releasing said gas and said liquid separately from the container, and a hose for feeding said gas and said liquid separately through a nozzle. The nozzle assembly includes longitudinal and radial inlets for feeding said gas and said liquid separately through a mixing chamber, and exiting orifices in an end surface of said nozzle assembly for issue of mixed gas and liquid in a fine mist.

22 Claims, 6 Drawing Sheets

LIQUID MIST FIRE EXTINGUISHER

FIELD OF INVENTION

This invention relates to a liquid mist fire extinguisher and more particularly a low pressure water atomizing fire extinguisher.

BACKGROUND TO THE INVENTION

Fires are classified as A, B, C or D as follows: Class A: ordinary combustibles; Class B: flammable liquids; Class C: electrical fires and Class D: flammable metals. Fire extinguishers are certified in Canada and the United States by ULC and UL respectively according to their effectiveness in suppressing the fires of the various classes. A standard extinguisher with an A:B:C rating for example, is effective in suppressing A, B and C class fires.

To achieve an A:B:C rating, extinguishers to date have used either dry chemicals or halon. The use of dry chemicals results in a messy and sometimes toxic cleanup. Halon is a clean alternative but has been banned by the Montreal Protocol on Substances that Deplete the Ozone Layer.

Water has also been used but prior art water extinguishers have not achieved an A:B:C rating. The standard water extinguisher for example discharges a solid stream of water from a pressurized canister and has a limited Class 2A rating.

Another type of known water extinguisher discharges a spray of water droplets and utilizes the same amount of water as the standard extinguisher. This extinguisher typically operates at about 100 psi. While this water extinguisher has been rated A:C, it does not generate the fine atomized mist required for a class B rating.

It is a feature of the present invention to provide an extinguisher in which water and air are stored together and released simultaneously and separately to produce a fine liquid mist, capable of class A:B:C rating.

SUMMARY OF THE INVENTION

In accordance with the present invention, there is provided an apparatus for producing a fine liquid mist, comprising a container for holding a gas and liquid under pressure; valve means for simultaneously releasing said gas and said liquid separately from said container; feed means for feeding said gas and said liquid separately to a nozzle; said nozzle including a mixing chamber and outlet orifices for emission of said liquid mists.

In another embodiment of the present invention, there is provided a release valve for simultaneously releasing a gas and a liquid separately from a pressurized container, comprising a first valve controlling a liquid outlet from said container; a second valve controlling a gas outlet from said container; means for feeding said liquid and said gas separately from said valves; means for actuating said valves, simultaneously.

In a further embodiment of the present invention, there is provided a liquid mist fire extinguisher, comprising a container for holding a gas and a liquid under pressure; a valve assembly at an upper end of said container; valve means for simultaneously releasing said gas and said liquid separately from said container; a hose for feeding said gas and said liquid separately through a nozzle; said nozzle assembly including means for feeding said gas and said liquid separately through a mixing chamber, and exiting orifices in an end surface of said nozzle assembly for issue of mixed gas and liquid in a fine mist.

DETAILED DESCRIPTION OF THE PREFERRED EMBODIMENTS

Figure 1:
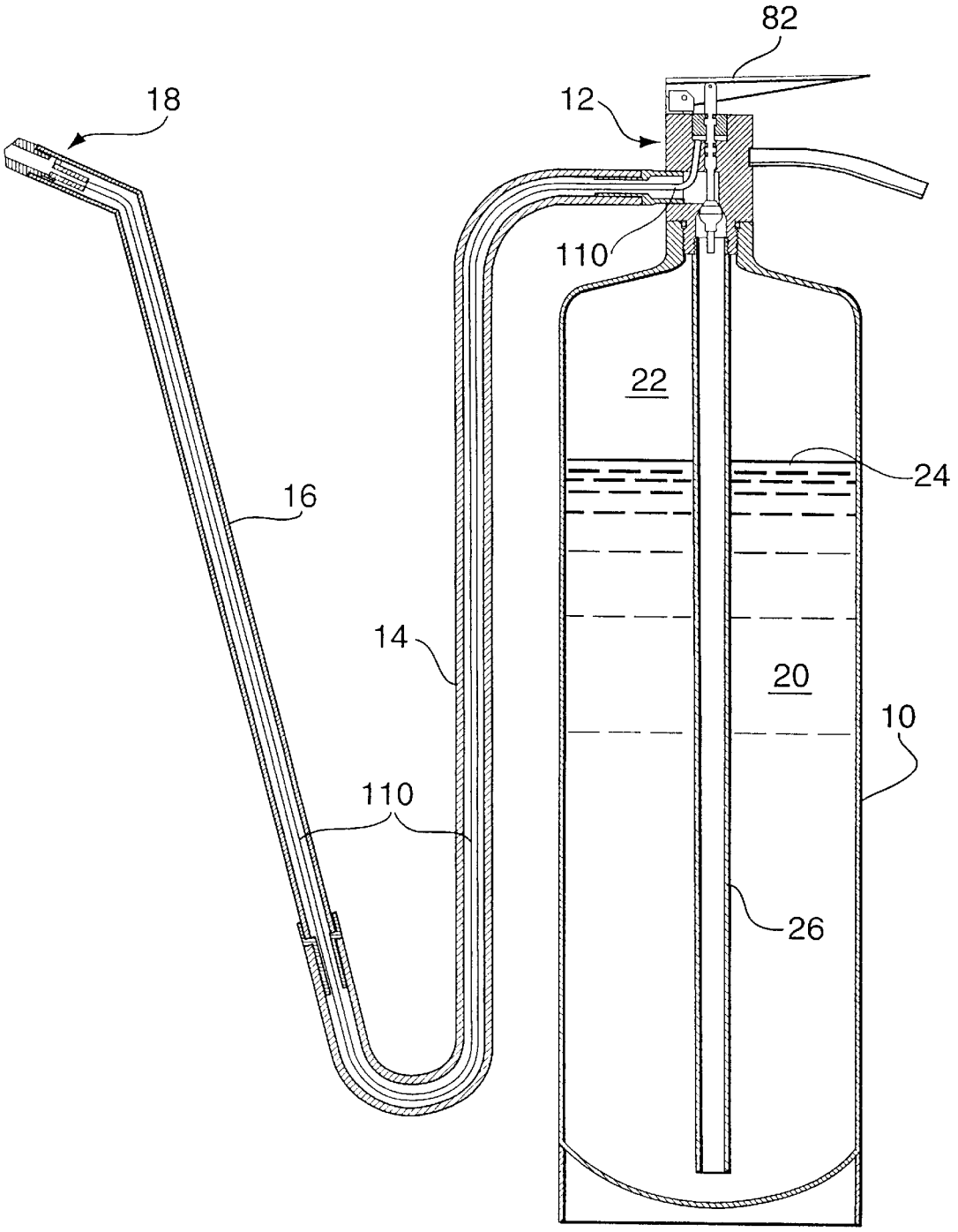
FIG. 1 is a cross-section of a fire extinguisher according to the present invention.

The drawings illustrate a fire extinguisher assembly having an A,B and C rating comprising a pressure container 10 of approximately 12 L capacity having at its upper end a valve structure 12, and flexible hose 14 with a relatively ridged wand portion 16, and a nozzle assembly 18 at the end of the wand 16. The valve structure 12 closes the upper end of the container which, in use contains a liquid, for example, water, and its lower portion 20 and a pressurizing gas, for example, air at its upper portion 22, the gas/liquid in the phase shown at 24. A tube 26 extends down and from the valve structure 12 towards the bottom of container, finishing a short distance above the bottom. The tube is connected at its upper end to the valve structure 12.

Figure 2:
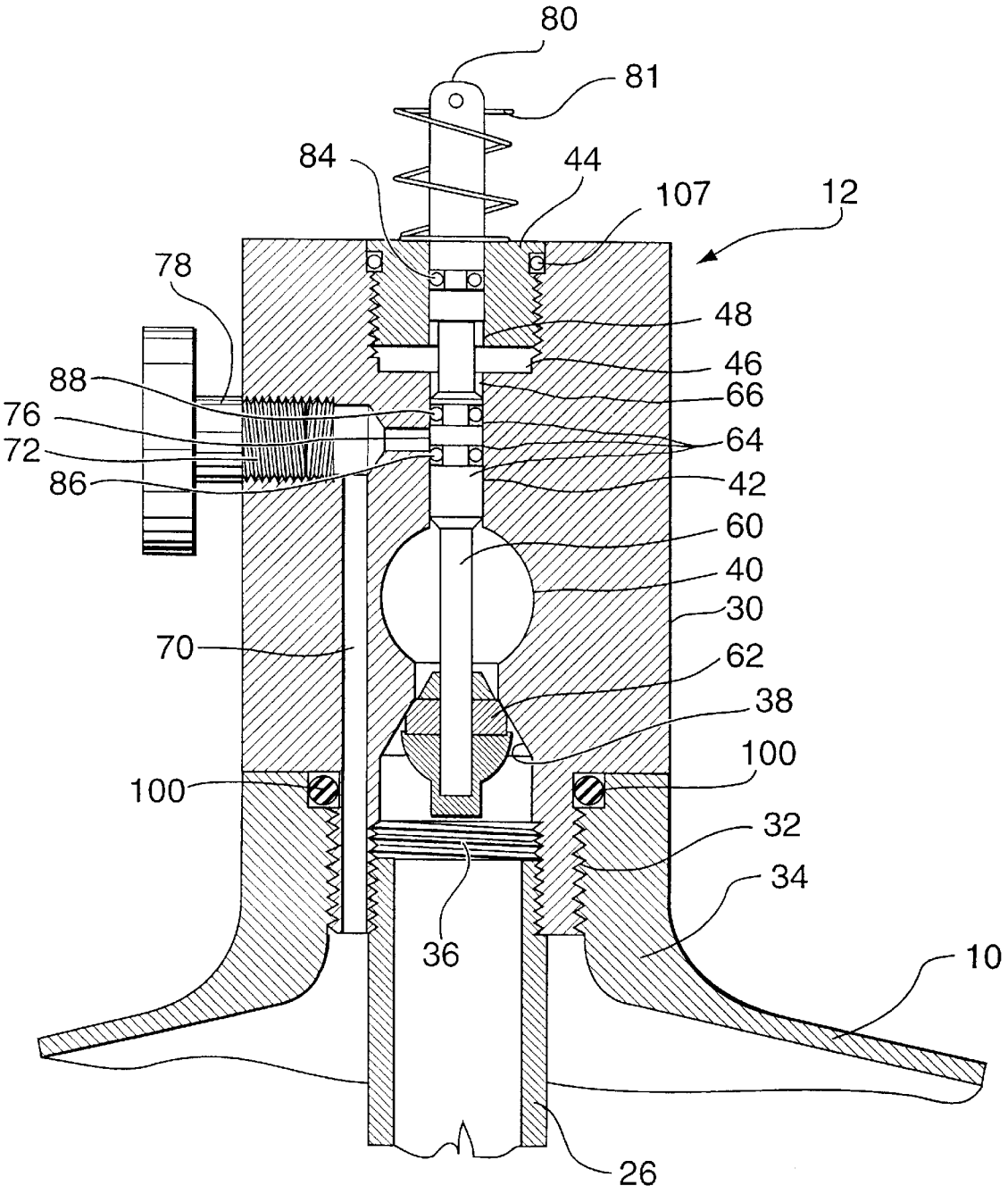
FIG. 2 is a cross-section of the valve structure at the top of the extinguisher of FIG. 1, to a larger scale, and at right angles to that of FIG. 1; with valve closed.
Figure 3:
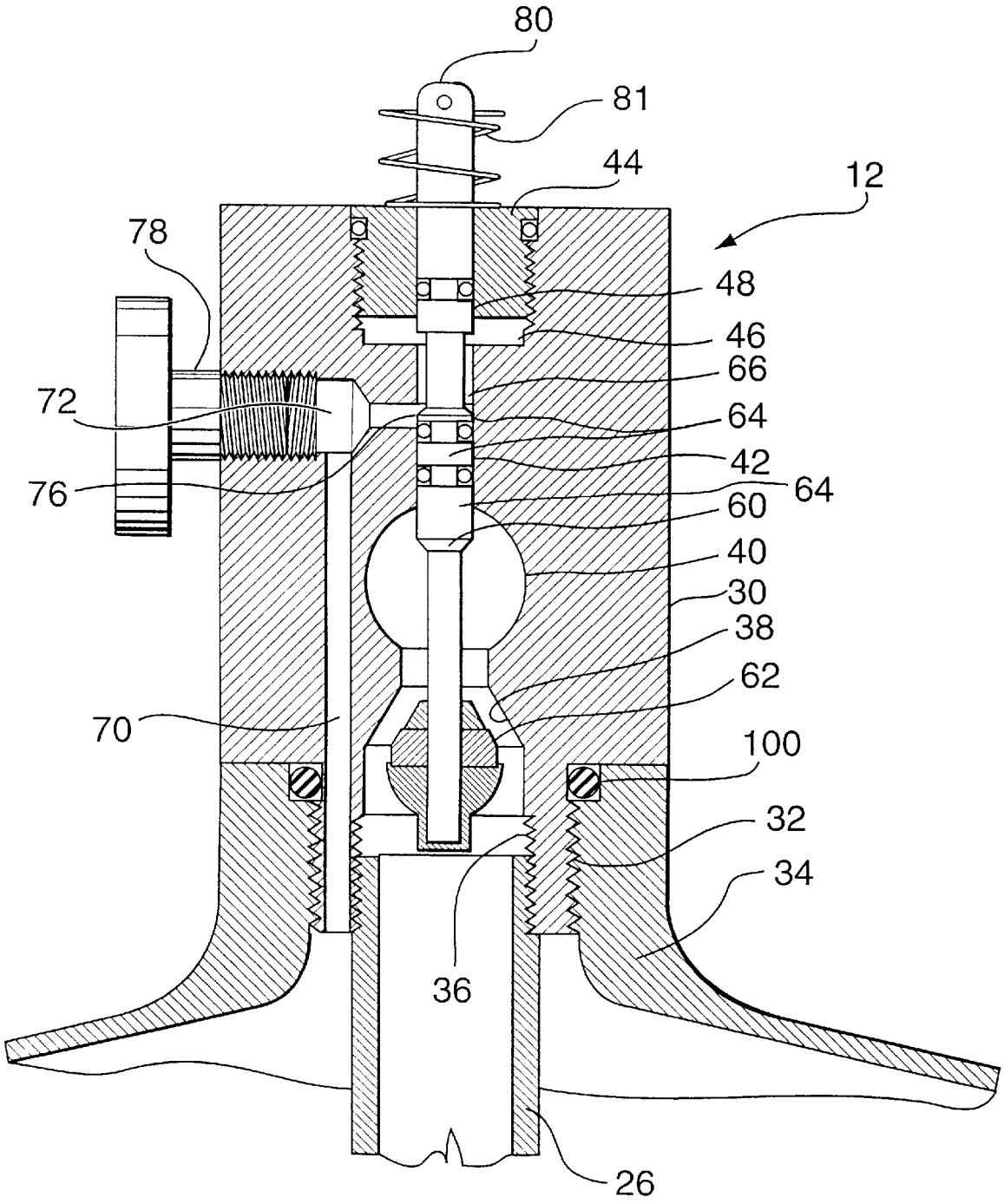
FIG. 3 is a cross section similar to that of FIG. 2, with valve open.

Considering FIGS. 2 and 3 specifically, the valve structure 12 comprises a main body 30, which is attached, by a fitted threaded connection 32 to a neck portion 34 at the upper part of container 10. The body 30 has a central longitudinal extending bore, having a varying dimension along its length. At its lower end 36, the bore is enlarged and receives the upper end of the tube 26, again conveniently a threaded connection. The bore is then tapered inwardly to form a valve seat 38. The bore enlarges, at 40, to form a fluid passage, described later in connection with FIG. 4. Above the enlargement 40, the bore decreases in size to form an elongate tubular seating at 42. Above the valve seat 42, the bore is enlarged and a plug 44 is inserted to close off the bore, and also to form a chamber which serves as a transfer passage 46, again described in more detail with respect to FIG. 4. The plug 44 has a central bore 48 and extending through the bore is an elongate valve member 60. At its lower end, the valve member has a tapered valve member 62 which cooperates with tapered valve seat 38, while at an intermediate position, an extended valve portion 64 cooperates with the tubular seating 42. Valve member 62 and valve seat 38 acts to control flow of liquid from container. The upper end of valve portion 64 acts with the upper end of seating 42 to control flow of gas from the container.

A further bore 70 extends up through the body 30 and connects to a radial bore 72 extending to the central bore to form a port 76, between the enlargement 40 and the passage 46. The outer end of the radial bore 72 is closed by a plug 78 which can be used to provide a connection to a pressure gauge. Considering the valve portion 64, a reduced diameter portion 66 on the valve member 60 connects with the passageway 46 only, in a closed position, as in FIG. 2, and connects passageway 46 with port 76, in an open position, as in FIG. 3.

The upper end 80 of the valve member 60 extends beyond the plug 48. A lever 82, see FIG. 1, is pivotally mounted on the end of the body 30 and extends over the outer end 80. A compression spring 81 is mounted on the outer end 80 of the valve member 60 to bias the valve member to a closed position. Pressure by the lever 82 on the outer end 80 of the valve member 60 will open the valves. Various seals are provided for the valve member 60. An O-ring 84 is provided between the passage 46 and the upper end surface of the body 30, in the example of the plug 48, to prevent leakage from the top end. Two further O-rings 86 and 88 are spaced apart in the valve portion 64 to prevent leakage from port 76 to the passage 46 and enlargement 40 in the valve closed position, and to prevent leakage from the port 76 to the enlargement 40 in the valve open position. O-rings 100 and 102 can be provided in a conventional manner to seal threaded connections 32 and the threaded connection between the plug 44 and the upper end of the body 30.

Figure 4:
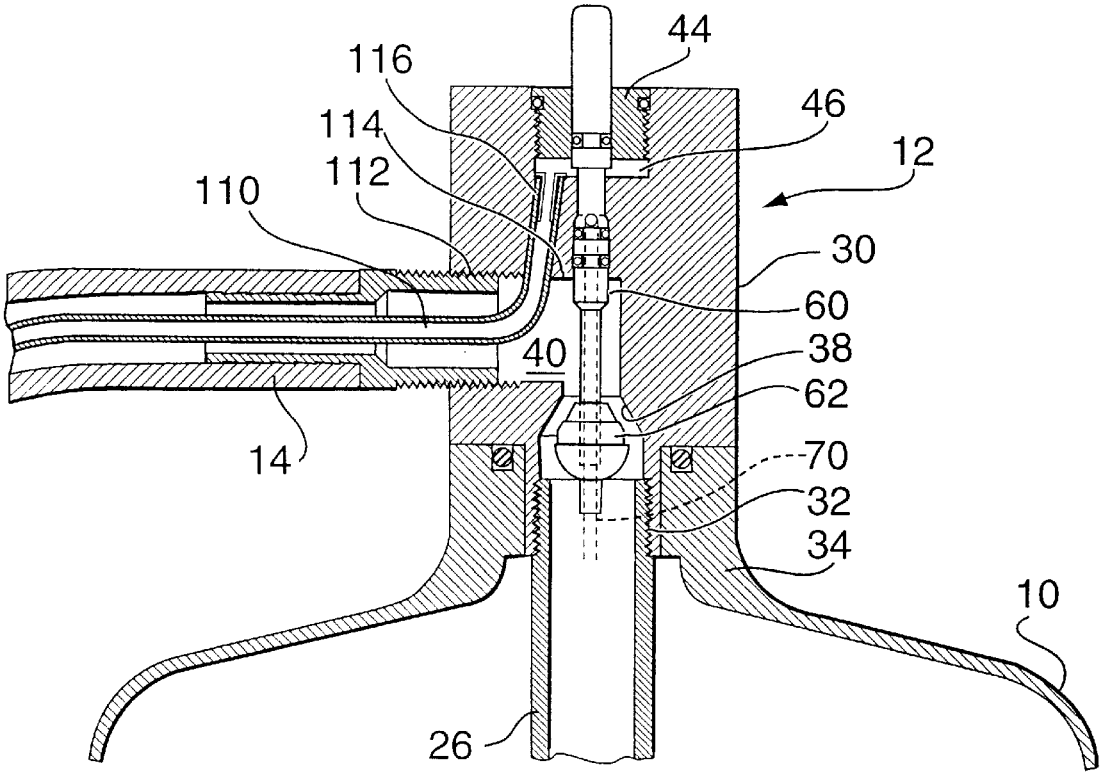
FIG. 4 is a cross section of the valve structure, on the axis of the cross section of FIG. 1.

FIG. 4 illustrates the attachment of the flexible hose 14 to the valve body 30, with connections to the enlargement 40, and also connection of a flexible tube 110, inside the hose 14 to the passage 46. The hose 14 is connected to the body 30 via a threaded connection 112 in a bore 114 connecting to the enlargement 40. The tube 110 extends up through a bore 116 in the top part of the body 30 to connect to the passage 46. As seen in FIG. 1, the tube 110 extends through the hose 14 and wand 16 to a nozzle assembly 18.

When the valves are closed, neither the liquid nor gas can flow from the container 10 to the nozzle assembly 18. Pushing down on the lever 82 opens the valves to a position as seen in FIG. 3. Liquid escapes up past the lower end of the valve member 60 into the enlargement 40 and up through bore 114 and connection 112 into the hose 14. Simultaneously, air escapes through bores 70 and 76, recess 66, passage 46 and then through the tube 110 to nozzle 18.

Figures 5, 6:
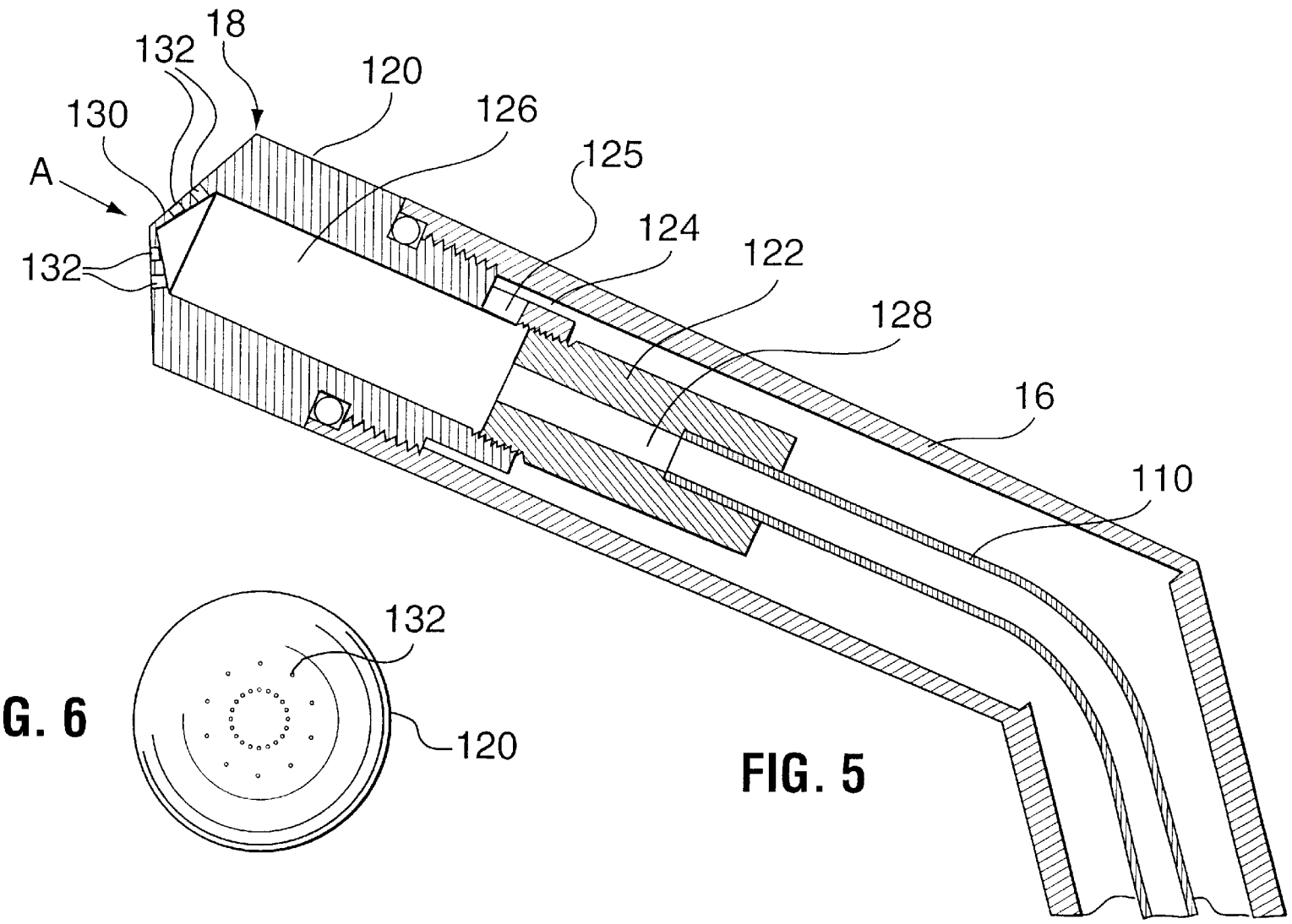
FIG. 5 is a longitudinal cross section through the nozzle.
FIG. 6 is an end view on the end of the nozzle member, in the direction of arrow A.

One form of nozzle assembly 18 is illustrated in FIG. 5. This assembly has a nozzle member 120 attached to the end of the wand 16 and an internal member 122 to which the tube 110 is attached. The orifice formed in the internal member 122 is preferably 0.75–1.5 mm in diameter. The member 122 is connected to the nozzle member 120 and a passage 124 provides access, via a port 125, to a mixing chamber 126 for the liquid in the wand 16. Port 125 is preferably 2–3.5 mm in diameter. Liquid enters the mixing chamber 126 at right angles to the longitudinal axis of the nozzle 18. Gas can flow through a central bore 128 of the member 122 into the mixing chamber 126. The nozzle member 120 is circular in cross section, and has a closed end with a number of orifices 132. One arrangement is seen in FIG. 6. The closed ends in face 130 are angled with respect to the longitudinal axis preferably in the range of 60° to 75°.

The gas enters the mixing chamber in a longitudinal direction and combines with the jet of liquid that is entering the mixing chamber at port 125. Thus, this will produce a gas/liquid mixture. The mixture exits the chamber through the orifices 132, resulting in further expansion and further atomization of the liquid. The orifice pattern combined with the amount of atomization and end face angles produces the described mist pattern.

To charge the container 10, about 6 L of liquid, for example water is placed in the container. The gas, for example air, is fed into the upper part of the container 10 through the wand 16 by removing the nozzle 120 and replacing it with an air valve (not shown). The gas source means is connected to the air valve, the valves are opened and air is fed into the container 10. After pressurization, the nozzle is replaced. Pressurization in this manner minimizes later tampering. As an alternative, the gas is fed through bore 72 by removing plug 78. As a further alternative, a pressure gauge can be permanently mounted at the bore 72, and this can be provided with a T-shaped valved connection having an air valve for connection of a pressurized source of gas. The gas is generally pressurized initially to a maximum pressure of about 175 pounds per square inch.

Figure 7:
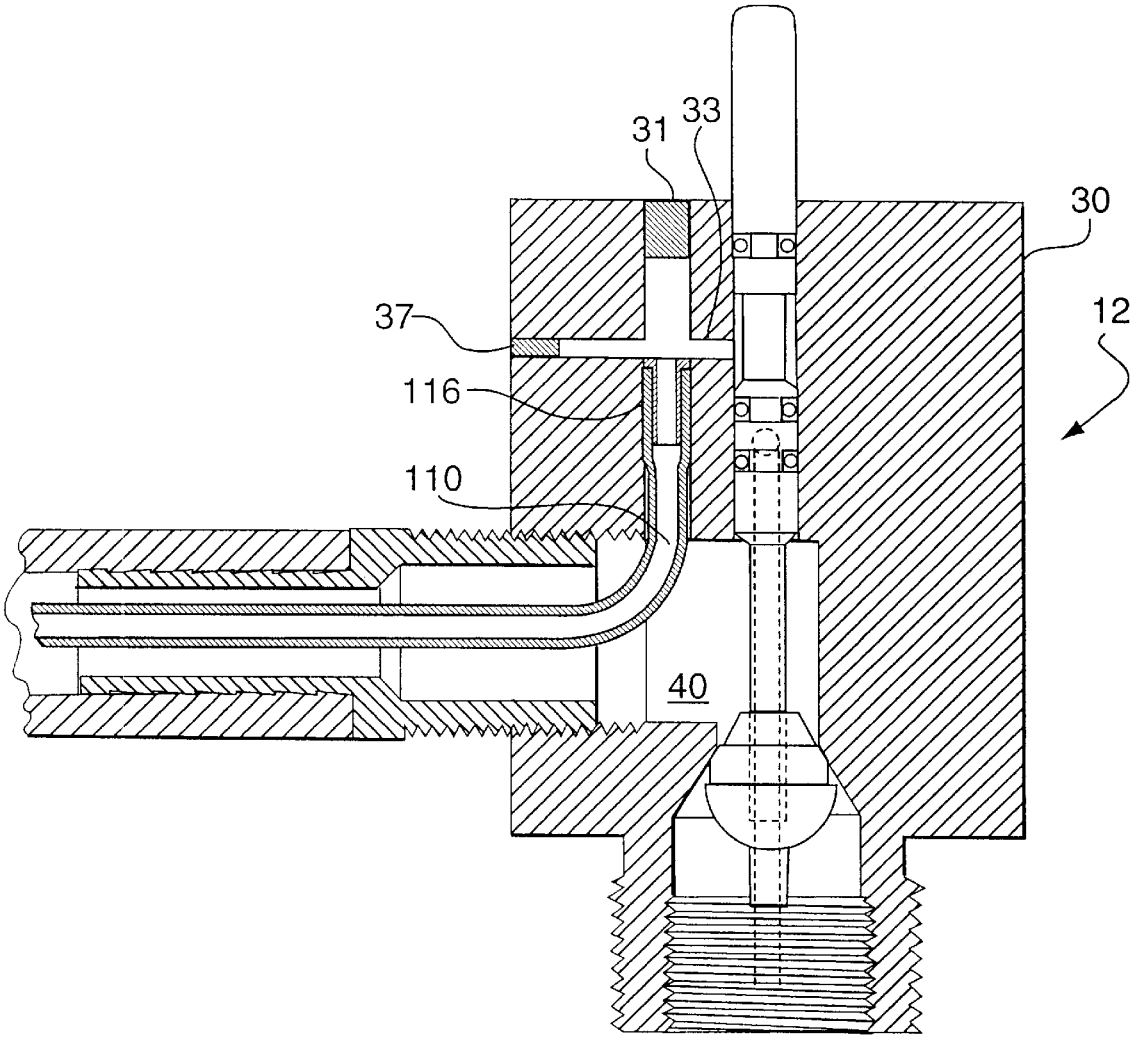
FIG. 7 is a cross-section of another embodiment of the valve structure of the present invention, on the axis of the cross-section FIG. 1.

FIG. 7 illustrates an alternate embodiment of the valve structure 12. The central longitudinal extending bore above enlargement 40 is not enlarged eliminating the need for a plug such as plug 44 in FIG. 4 to close off the bore. The bore 116 extends through the top of the valve body 30. The top of the bore 116 is closed by a plug 31. A second bore 33 serves as a transfer passage in place of the chamber 46 (see FIG. 4), and is closed by plug 37. The valve structure 12 is otherwise the same as the previous embodiment including the tube 110 which extends up through bore 116.

A carrying handle can be attached through the valve structure 12 as seen in FIG. 1. The container is shaped so that such can normally stand upright on a surface.

I claim:

1. A liquid mist fire extinguisher, comprising;

a container for holding a gas and a liquid under pressure;

a valve assembly at an upper end of said container;

valve means for simultaneously releasing said gas and said liquid separately from said container;

a hose for feeding said gas and said liquid separately through a nozzle assembly;

said nozzle assembly including means for feeding said gas and said liquid separately through a mixing chamber, and exiting orifices in an end surface of said nozzle assembly for issue of mixed gas and liquid in a fine mist to suppress A, B and C class fires.

2. A fire extinguisher as claimed in claim 1, including a tube within the hose for feeding said gas.

3. A fire extinguisher as claimed in claim 2, said valve means comprising a first valve controlling a liquid outlet from said container, a second valve controlling a gas outlet from said container, means for feeding said liquid and said gas separately from said valves, and means for actuating said valves simultaneously.

4. A fire extinguisher as claimed in claim 3, said first valve formed at one end of said valve member, said second valve formed at a position intermediate at the other end of said valve member and said first valve, said means for actuating the said valves simultaneously positioned at the other end of said valve member.

5. A fire extinguisher as claimed in claim 4, wherein said first valve has an enlarged valve seal further movable axially to open and close a flow passageway.

6. A fire extinguisher as claimed in claim 5, further comprising a reduced section at said intermediate position, axially spaced inlets and outlets, said reduced section movable axially to a position connecting said inlets and outlets.

7. A fire extinguisher as claimed in claim 6, comprising a valve body, an elongated member positioned in a bore in said body, said passageway formed at one end of said bore, and means for feeding said liquid from said passageway to an outlet in a said bore.

8. A fire extinguisher as claimed in claim 7, comprising means of feeding gas through said body to a port in said bore and a chamber in said body at the outer end of said bore, said second valve comprising an extended portion movable to connect and disconnect said port to said chamber and means for feeding said gas from said chamber to said outlet.

9. A fire extinguisher as claimed in claim 8, including connection means for connecting a feed means to said outlet and feeding said liquid and said gas separately to said feed means.

10. A fire extinguisher as claimed in claim 7, comprising means of feeding gas through said body to a port in said bore and a transfer passage in said body at a position intermediate the outer end of said bore, said second valve comprising an extended portion movable to connect and disconnect said port to said transfer passage and means for feeding said gas from said transfer passage to said outlet.

11. A fire extinguisher as claimed in claim 10, including connection means for connecting a feed means to said outlet and feeding said liquid and said gas separately to said feed means.

12. A fire extinguisher according to claim 1, wherein said nozzle assembly includes an angled face at one end.

13. An apparatus for producing a fine liquid mist, comprising:

a container for holding a gas and liquid under pressure;

valve means for simultaneously releasing said gas and said liquid separately from said container;

a nozzle including a mixing chamber and outlet orifices for emission of said liquid mist, said outlet orifices being at one end of said mixing chamber;

feed means for feeding said gas and said liquid separately from said container to said mixing chamber; and said mixing chamber having two separate inlets at another end, a first inlet for injection of said liquid radially into the mixing chamber and a second inlet for injection of said gas longitudinally into said mixing chamber for atomization of said liquid.

14. A release valve adapted for simultaneously releasing a gas and a liquid separately from a pressurized source containing gas and liquid and to permit feeding of liquid and gas as individual, separate fluid streams to and through said valve, comprising:

a first flow control valve for controlling and regulating the flow of liquid from said pressurized source to a first liquid supply means;

a second flow control valve for controlling and regulating the flow of gas from said pressurized source to a second gas supply means; and single actuating means directly connected to both of said valves for simultaneously actuating said valves to simultaneously release gas and liquid separately from said sources.

15. A release valve according to claim 14, comprising an elongate valve member, said first valve formed at one end of said valve member, said second valve formed at a position intermediate the other end of said valve member and said first valve, said means for actuating said valves positioned at the other end of said valve member.

16. A release valve according to claim 15, said first valve further comprising an enlargement at said one end, movable axially to open and close an orifice.

17. A release valve according to claim 16, further comprising a reduced section at said intermediate position, axially spaced inlets and outlets, said reduced section movable axially to a position connecting said inlets and outlets.

18. A release valve according to claim 17, comprising a valve body, said elongate member positioned in a bore in said valve body, said orifice formed at one end of said bore, and means for feeding said liquid from said orifice to an outlet in said bore.

19. A release valve according to claim 18, comprising means for feeding gas through said body to a port in said bore and a chamber in said body at the other end of said bore, said second valve comprising an extended portion movable to connect and disconnect said port to said chamber and means for feeding said gas from said chamber to said outlet.

20. A release valve according to claim 19, including connection means for connecting a feed means to said outlet and feeding said liquid and said gas separately to said feed means.

21. A release valve according to claim 18, comprising means for feeding gas through said body to a port in said bore and a transfer passage in said body at a position intermediate the other end of said bore, said second valve comprising an extended portion movable to connect and disconnect said port to said transfer passage and means for feeding said gas from said transfer passage to said outlet.

22. A release valve according to claim 21, including connection means for connecting a feed means to said outlet and feeding said liquid and said gas separately to said feed means.

* * * * *